United States Patent [19]

Newbold et al.

[11] Patent Number: 5,015,513

[45] Date of Patent: May 14, 1991

[54] SEALABLE CONTAINERS

[75] Inventors: Geoffrey Newbold, Wirral; Douglas Wraige; John D. Wagner, both of Cheshire, all of England

[73] Assignee: Lever Brothers Company, Division of Conopco, Inc., New York, N.Y.

[21] Appl. No.: 53,223

[22] Filed: May 22, 1987

[30] Foreign Application Priority Data

May 23, 1986 [GB] United Kingdom ..... 8612706

[51] Int. Cl.[5] ..... C11D 17/04

[52] U.S. Cl. ..... 428/35.5; 206/524.7; 252/90; 428/349

[58] Field of Search ..... 206/524.7; 428/35, 835.5; 252/90, 174

[56] References Cited

U.S. PATENT DOCUMENTS

| | | | |
|---|---|---|---|
| 2,760,942 | 8/1956 | Oakley | 260/17.4 |
| 3,895,905 | 7/1975 | Albert | 206/524.7 |
| 4,188,304 | 2/1980 | Clarke et al. | 252/93 |
| 4,356,099 | 10/1982 | Davies | 206/524.7 |
| 4,555,354 | 11/1985 | Clarke et al. | 252/90 |
| 4,626,372 | 12/1986 | Kaufmann et al. | 206/524.7 |

FOREIGN PATENT DOCUMENTS

| | | | |
|---|---|---|---|
| 0011968 | 6/1980 | European Pat. Off. . | |
| 143476 | 6/1985 | European Pat. Off. . | |
| 0157612 | 10/1985 | European Pat. Off. | 252/90 |
| 2000177 | 1/1979 | United Kingdom . | |
| 1583082 | 1/1981 | United Kingdom . | |
| 2090603 | 7/1982 | United Kingdom | 206/524.7 |

*Primary Examiner*—James J. Seidleck

*Attorney, Agent, or Firm*—Milton L. Honig

[57] ABSTRACT

A container having at least one opening seal, which seal is mechanically strong in the dry state but disintegrates in water at temperature of 40° C. or below under the influence of mechanical agitation. The seal is formed from a mixture of a water-labile adhesive and a heat-sealable component.

3 Claims, No Drawings

SEALABLE CONTAINERS

FIELD OF THE INVENTION

The present invention relates to sealable containers especially sealable sachets and other flexible containers, more especially to sealable, detergent containing sachets.

BACKGROUND AND PRIOR ART

Detergent containing sachets sealed with a water-sensitive coating composition are known from U.S. Pat. No. 2,760,942 (Hercules) and GB 1 583 082 (Unilever). GB 1 583 082 discloses a detergent sachet the seams of which are sealed with water soluble adhesives such as polysaccharides or polyvinyl alcohol.

Detergent containing sachets which are sealed with mechanically weak heat seals, which rupture when agitated, are described in EP 11 500B (Unilever).

GB 2 000 177B (Akzo) discloses detergent sachets sealed with material that disintegrates in the wash water at temperatures of from 40° to 60° C. The seal may consist of a mixture of polyethylene glycol which melts at 42° C., together with a thermoplastic acrylic resin.

EP 143 476A (Akzo) discloses detergent sachets of heat-sealable material sealed with an anionic and/or water binding polymer, and a cationic polymeric adhesive, for example, polyethyleneimine.

Sachets intended to give sequential release are described, for example in European Patent Application No. 87 301905.3 (Unilever) filed on Mar. 5, 1987. Such sachets tend, however, to be of complicated construction.

Although containers provided with heat-sealed seams are known they do not provide the opening qualities required for many applications. Containers provided with liquid-labile seams are also known but they have a tendency to open prematurely during storage in the humid conditions found in many kitchens and bathrooms.

DEFINITION OF THE INVENTION

The present invention provides a heat-sealable, liquid-labile closure. According to the invention there is provided a container adapted for delivering a treatment material into an environment comprising both water and mechanical agitation, the container having at least one opening seal mechanically strong in the dry state but which disintegrates in water at temperatures of 40° C. or below under the influence of mechanical agitation, the seal being formed from a mixture of (i) an adhesive component labile in water at temperatures of 40° C. or below and (ii) a heat-sealable component insoluble in water at temperatures of 40° C. or below.

DETAILED DESCRIPTION OF THE INVENTION

The container of the invention includes as an essential feature an opening seal between two walls, the opening seal being formed from a mixture of the two components (i) and (ii) defined above. In the description that follows, the mixture of (i) and (ii) will be referred to as the sealant.

Nature of the container walls

The walls of the container are preferably of non-heat-sealable material. By non-heat-sealable material it is meant that the material does not heat-seal to itself at temperatures up to 30° C. greater than the lowest temperature at which the sealant used is heat-sealable. Although it is not essential that the walls are of non-heat-sealable material, it is important that the temperature, duration and pressure of the sealing process are such that the container walls are not directly bonded to one another over large areas without the involvement of an intermediate layer of sealant. The containers are preferably heat-sealed but other methods of sealing including pressure, ultrasonics and high frequency induction may be used. The container will, in general, open more rapidly if at least one wall (or surface) is water-permeable than if all the the walls are impermeable. The walls may be in any form although flexible materials such as webs or sheets of woven, knitted or non-woven fabric or paper are preferred. The wall material is preferably fibrous but may also be filamentary, slitted or foraminous. Suitable fibrous materials include cellulose, cellulose/regenerated cellulose mixtures, polyesters, and mixtures thereof.

In preferred embodiments the walls are comprised of sausage casing paper, a viscose/cellulose mix, which is preferred because of its greater wet strength than many other papers especially at elevated temperatures.

The container walls preferably have a base weight of 5 to 100 $gm^{-2}$, more preferably 10 to 60 $gm^{-2}$ and especially 15 to 40 $gm^{-2}$.

If the container walls are very permeable then the contents may be leached out before the container seals open. This may be a disadvantage if a delayed release of the container contents is required. The problem may be overcome by using less permeable walls.

The Labile Adhesive Component (i)

The labile adhesive component can be any adhesive material which is labile in water at temperature of 40° C. or below. The term "labile" means that the adhesive is dissolved or otherwise disrupted by water, for example, by swelling or dispersion, such that the bond formed by the sealant is significantly weaker in the wet state than in the dry state: typically a seam having the dimensions of $1.5 \times 0.5$ cm may have a bond strength as high as 3N or more in the dry state, but on immersion in water the bond strength could be reduced to less than 0.2N. The bond strength may be measured by means of an Alwetron (Trade Mark) Tensiometer.

Preferably, the adhesive component is water-soluble at a temperature of 40° C. or below.

Preferred water-soluble adhesives are polyvinyl pyrrolidone, polyvinyl alcohol or dextrin. Polyvinyl alcohol, however, reacts with borate ions in solution to form poorly soluble crosslinked polymeric systems, and is therefore not preferred for use in containers which contain borates or materials, such as sodium perborate, which decompose to liberate borate ions.

The Sealable Component (ii)

The precise nature of the sealable component is not critical, but it must be insoluble in water at temperatures of 40° C. or below. In particular the sealable component may be polyvinyl acetate, a vinyl acetate-ethylene copolymer or a polyacrylic ester. The adhesive components may in general be used as supplied by the manufacturers and may contain small amounts of other materials such as impurities and plasticisers.

The Sealant Mixture

In use, the time taken before the seal ruptures may be varied by using differing proportions of the components (i) and (ii) to make up the sealant. For example, a high proportion of the heat-sealable component leads to a seal which remains intact for longer when immersed in water than a seal prepared using the same materials and a lower proportion of the heat-sealable component. If too high a proportion of the heat-sealable component is used then the seal may not rupture quickly enough in use. If too high a proportion of the water-labile component is used then the seal may be difficult to form by heat-sealing and may rupture too quickly in use.

The relative amounts of each component may be varied at will to give a seam which opens at the required time. Simple experimentation well within the capability of one skilled in the art is required to give the required opening time. Typical proportions of adhesive component to heat-sealable component are, on a dry weight basis, 50:1 to 1:50, more preferably 20:1 to 1:20 and still more preferably 5:1 to 1:5.

The heat-sealable component is preferably in the form of an emulsion containing 40–55 wt % solids, the emulsion comprising 30 to 90 wt % of the sealant composition. The water-labile component of the sealant composition is preferably in the form of a solution containing 10 to 60 wt % of solids and comprising 10 to 70 wt % of the sealant composition.

The two components are mixed together to form a sealant mixture. For ease of application this preferably has a viscosity at 25° C. in the range 1000 to 6000 cps. This viscosity range is preferred as many conventional coating machines are only able to handle mixtures within this viscosity range. The sealant mixture as applied preferably contains 20 to 55 wt % solids.

Preferably the sealant is in the form of a viscous emulsion which is applied to one side of the surface and dried to give a coating which is flexible enough not to crack when the surface is flexed. This is especially valuable in embodiments where the surfaces to be sealed together are themselves flexible, and, for example, allows sachets to be manufactured on high-speed sachet-making apparatus.

If the sealant mixture is applied in viscous form, then one coat is generally sufficient. However, if the mixture is less viscous then two coats of the sealing composition may be advantageously applied to each wall. The first coat sizes the surface and the second coat forms a layer on the surface. Superior heat-sealing occurs, in general, if both surfaces to be sealed are coated with the composition.

The sealant composition is preferably applied to the surface using conventional roller coating equipment to give a dry, flexible coating which can be heat-sealed at 170° to 200° C. at a pressure of 3 bar and a time of 0.5 seconds on a conventional sachet forming machine. Such machines enable flexible containers of the invention to be made rapidly and easily. Preferably, the dry bond formed between the wall and the sealant composition should be strong enough to result in tearing of the non-heat-sealable material rather than rupture of the bond. Other ways of applying the sealant and sealing the substrates will, of course, readily suggest themselves to one skilled in the art.

Sachet Embodiments

According to a preferred embodiment, the container of the invention is a sachet. Sachets in accordance with the invention are preferably rectangular or square and made with four opening seals or one fold and three opening seals, although in principle one opening seal is sufficient. Sachets also including non-opening seals are within the scope of the present invention but pattern coating may then be required.

Sachets can be made by forming the material into a pouch with the coating on the inside. The contents are then introduced and the sachet sealed.

The present invention is of use both for single compartment sachets which deliver their contents very rapidly and also for multicompartment sachets which deliver the contents of the compartments sequentially by the use of a number of seals opening at different times.

Container Contents

The contents of the container may be in any physical form. Preferably the contents are in particulate form. The container may contain any substances which are compatible with the materials of which the article of the invention is constructed. Aqueous liquids should, for example, be avoided as they would weaken the seal prematurely. The invention is of especial applicability to the home laundry process, and preferred contents of the article of the invention include fully formulated detergent compositions, bleaches, bleach precursors, fabric softeners, stain removing agents and anti-bacterial agents. The article of the invention is not only of use in the washing and dishwashing fields, and other contents and possible fields of use will, of course, be readily apparent to one skilled in the art.

Although the invention has been illustrated by reference to opening in an aqueous environment, one skilled in the art will readily recognise that containers opening in other solvent systems are within the scope of the invention.

EXAMPLES

The invention will be illustrated by the following non-limiting examples. All coating levels are on a dry basis.

EXAMPLE 1

| | |
|---|---|
| Sealant | |
| Datac (Trade Mark) 533 (Polyvinyl acetate/water emulsion, 53% solids, viscosity 3000 cps) | 40 wt % |
| National (Trade Mark) 018-1074E Aqueous polyvinyl alcohol, 12% solids, viscosity 6000 cps | 60 wt % |
| Substrate | |
| Non-heat-sealable, tea-bag paper | 18 $gm^{-2}$ |

Two coats of sealant in amounts of 16 $gm^{-2}$ and 8 $gm^{-2}$ respectively were applied to the substrate, which was dried at 60° C. between each coat. A sachet 150 mm square, containing 150 g of detergent powder was formed by heat sealing the coated paper at 180° C. at 45 psi (3 bar) for 0.5 second. The sachet opened after agitation in water for one minute at 40° C.

EXAMPLE 2

| | |
|---|---|
| Sealant | |
| Datac 533 | 90 wt % |
| National 018-1047E | 10 wt % |
| Substrate | |
| As Example 1. | |

A sachet was formed as described in Example 1. The sachet opened after agitation in water for ten minutes.

| | |
|---|---|
| Sealant | |
| Vinamul (Trade Mark) 3265 (Copolymer of vinyl acetate with 25% ethylene, 53% solids viscosity 3000 cps at 25° C.) | 50 wt % |
| National 018-1074E | 50 wt % |
| Substrate | |
| As Example 1. | |

Two coats of sealant in amounts of 8 $gm^{-2}$ dry were applied to the substrate by a roller coating machine fitted with a heated drum and hot-air drying system. The coated paper was formed into 150 mm square sachets filled with 60 g of detergent powder using an Ilapack type sachet making machine. The sachet opened within 2to 4 minutes of coming into contact with wash water when tested in a washing machine set at 40° C.

EXAMPLE 4

| | |
|---|---|
| Sealant | |
| As Example 1 | |
| Substrate | |
| Sausage Casing Paper | 21 $gm^{-2}$ |

Two coats of sealant in amounts of 10 $gm^{-2}$ respectively were applied to the substrate which was dried at 60° C. between each coat. A sachet 150 mm square, containing 150 g of detergent powder was formed by heat-sealing the coated paper at 180° C. at 45 psi (3 bar) for 0.5 second. The sachet opened after agitation in water for two minutes at 40° C.

EXAMPLES 5 TO 9

A range of sachets differing in the relative proportions of the labile adhesive component and the heat-sealable component of the seam were made in order to study the effect on opening time.

All the sachets were made of sausage casing paper having a base weight of 21 $gm^{-2}$. The results are shown in Table 1 and it may readily be seen that the opening time is a function of the sealant composition.

EXAMPLES 10 TO 15

A similar series of experiments to those described in Examples 5 to 9 were performed using a coffee bag paper sold under the Trade Mark, Crompton 824. The results are shown in Table 2.

TABLE 1

Examples 5–9

| Example | Datac 533 (wt % of emulsion) | National 018-1074E (wt % of solution) | Coating level ($gm^{-2}$) | Dry Bond Strength* (N) | Opening Time (min) |
|---|---|---|---|---|---|
| 5 | 70 | 30 | 45 | 14.2 | 5.5 |
| 6 | 50 | 50 | 37 | 12.5 | 2.5 |
| 7 | 40 | 60 | 32 | 7.7 | 1 |
| 8 | 30 | 70 | 30 | 5.8 | 1 |
| 9 | 20 | 80 | 28 | 5.2 | 0.5 |

*measured on strip 1.5 × 0.5 cm using Alwetron (Trade Mark) tensiometer

TABLE 2

Examples 10–15

| Example | Datac 533 (wt % of emulsion) | National 018-1074E (wt % of solution) | Coating level ($gm^{-2}$) | Dry Bond Strength (N) | Opening Time (min) |
|---|---|---|---|---|---|
| 10 | 70 | 30 | 44 | 9 | 5 |
| 11 | 60 | 40 | 38 | 9.6 | 4 |
| 12 | 50 | 50 | 40 | 9.6 | 3 |
| 13 | 40 | 60 | 32 | 10.1 | 2 |
| 14 | 30 | 70 | 27 | 9.7 | 2 |
| 15 | 20 | 80 | 23 | 8.1 | 1 |

EXAMPLE 16 a sachet product displaying sequential release was prepared as follows: A strip of polyethylene laminated cellulosic non-woven fabric of base weight 30 $gm^{-2}$ (Storalene (Trade Mark)) of dimensions 10×20 cm was coated with a 1:1 mixture of Datac 533 and National 018-1074E at a coating level of 16 $gm^{-2}$ over an area of 10×10 cm extending from one short edge of the fabric and dried. The remaining surface of that side was coated at the same level with a 9:1 mixture of Datac 533 and National 018-1074E and dried. Conventional detergent powder (50 g) and sodium bromide (1.6 g) was placed on the 1:1 'side' and potassium monopersulphate (8 g) on the 9:1 'side'. The fabric was folded along the major axis and heat-sealed along the edges and middle to form two, joined 10×10 cm sachets, one containing the detergent powder and the other the per-salt. The sachet was introduced into a conventional washing machine. At 40° C., the detergent was released into the wash liquor after 2.5 minutes and the per-salt after 11 minutes.

EXAMPLE 17

A sachet identical to that prepared in Example 1 was prepared with the exception that the sachet was sealed by high frequency induction. The sachet opened after agitation in water for one minute at 40° C.

We claim:

1. A container formed from flexible materials adapted for delivering a treatment material into an environment comprising both water and mechanical agitation, the container having between two flexible walls thereof, at least one opening sealed mechanically strong in the dry state but which disintegrates in water of temperatures of 40° C. or below under the influence of mechanical agitation, the seal being formed from a mixture of:

(i) an adhesive component soluble in water at temperatures of 40° C. or below and (ii) a heat-sealable component insoluble in water at temperatures of 40° C. or below.

wherein the heat-sealable component is selected from the group consisting of vinyl acetate homopolymers, vinyl acetate/ethylene copolymers and polyacrylic acid esters.

2. A container formed from flexible materials adapted for delivering a treatment material into an environment comprising both water and mechanical agitation, the container having between two flexible walls thereof, at least one opening sealed mechanically strong in the dry state but which disintegrates in water of temperatures of 40° C. or below under the influence of mechanical agitation, the seal being formed from a mixture of:

(i) an adhesive component soluble in water at temperatures of 40° C. or below and (ii) a heat-sealable component insoluble in water at temperatures of 40° C. or below.

wherein the ratio of adhesive component to heat-sealable component ranges from 4:1 to 1:1.

3. A container formed from flexible materials adapted for delivering a treatment material into an environment comprising both water and mechanical agitation, the container having at least one opening seal between two non-heat-sealable walls, the opening seal being a heat seal mechanically strong in the dry state but which disintegrates in water at temperatures of 40° C. or below under the influence of mechanical agitation, the heat seal being formed from a mixture of:

(i) an adhesive component soluble in water at temperatures of 40° C. or below and (ii) a heat-sealable component insoluble in water at temperatures of 40° C. or below, wherein the ratio of adhesive component to heat-sealable component ranges from 4:1 to 1:1.

* * * * *